United States Patent [19]

Mannerstedt, deceased et al.

[11] Patent Number: 4,915,064

[45] Date of Patent: Apr. 10, 1990

[54] INTERNAL COMBUSTION ENGINE WITH OPPOSED PISTONS

[76] Inventors: Folke K. E. Mannerstedt, deceased, late of Bromma; by Margareta Zinnerström, executrix, Minnebergsvägen 3, 161 34 Bromma, both of Sweden

[21] Appl. No.: 254,474

[22] PCT Filed: Feb. 6, 1987

[86] PCT No.: PCT/SE87/00056

§ 371 Date: Dec. 5, 1988

§ 102(e) Date: Dec. 5, 1988

[87] PCT Pub. No.: WO88/05858

PCT Pub. Date: Aug. 11, 1988

[51] Int. Cl.[4] ..... F02B 75/26

[52] U.S. Cl. ..... 123/58 AM; 123/542; 123/65 B; 123/71 R

[58] Field of Search ..... 123/58 A, 58 AB, 58 AM, 123/41.69, 65 B, 65 BA, 71 R, 542, 541

[56] References Cited

U.S. PATENT DOCUMENTS

| | | | |
|---|---|---|---|
| 2,417,487 | 3/1947 | Hall | 123/58 AB |
| 3,574,997 | 4/1971 | Syrovy | 123/58 AB |
| 4,090,478 | 5/1978 | Trimble et al. | 123/58 A |
| 4,510,894 | 4/1985 | Williams | 123/58 A |
| 4,635,590 | 1/1987 | Gerace | 123/58 AM |

FOREIGN PATENT DOCUMENTS

| | | | |
|---|---|---|---|
| 1155767 | 10/1983 | Canada | 123/58 A |
| 0043259 | 3/1980 | Japan | 123/71 R |

*Primary Examiner*—David A. Okonsky

*Attorney, Agent, or Firm*—Burns, Doane, Swecker & Mathis

[57] ABSTRACT

A combustion engine comprises a plurality of cylinders. Each cylinder contains aligned pistons displaceable toward and away from one another. Rotary cam disks are connected to a drive shaft and are arranged to be contacted by respective ones of the pistons for transferring motion therebetween. Each cam disc includes a cam curve arranged to be engaged by respective pistons of each pair of pistons. Each cam curve has circumferentially spaced peaks and valleys interconnected by an interconnecting surface with which the cams make contact during a power stroke. The interconnecting surface is of concave configuration and presents a slope which progressively decreases from adjacent the peak to adjacent the valley.

8 Claims, 4 Drawing Sheets

Fig. 4
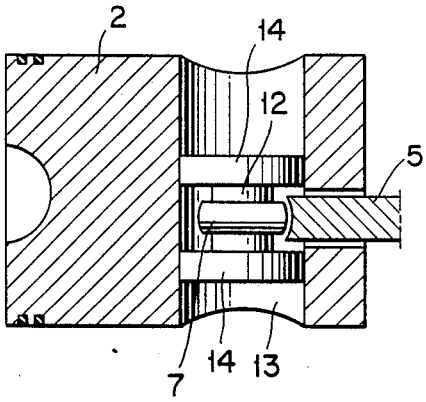
Fig. 5
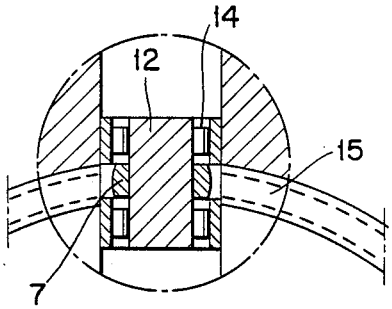
Fig. 6
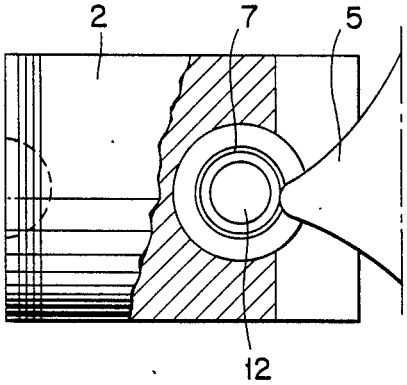
Fig. 7
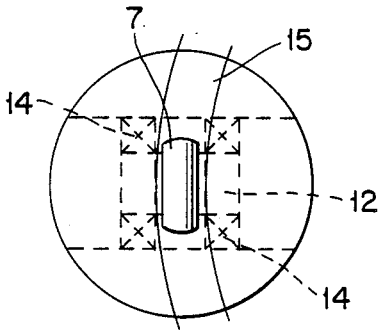
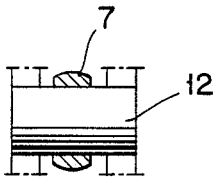
Fig. 8

INTERNAL COMBUSTION ENGINE WITH OPPOSED PISTONS

BACKGROUND AND OBJECTS OF THE INVENTION

The invention relates to a combustion engine of the Junkers type, i.e. with opposed pistons, in which the motion between piston and driveshaft and vice versa is transferred with a cam disc on the driveshaft. The engine has several cylinders, each with inlet and exhaust ports. The pistons of the engine have a cam roller to transfer the motion between the piston and the drive shaft and vice versa, the cam roller being arranged to be in contact with a cam curve on the driveshaft. The engine according to the invention has been designated the Diesex 4 engine.

Over the past three-quarters of the century our engine designers have steadily increased the number of horsepower per 100 kg weight of engines, reduced their fuel consumption per horsepower-hour and increased their combustion pressure.

At the beginning of the twentieth century, an engine of only a few horesepower would weigh 100 kg, the fuel consumption was about half a kilo or more per horsepower per hour, and the combustion pressure was about 20–30 kg/cm$^2$. By the 1950s, these figures had been improved to 10–15 hp per 100 kg for heavy duty engines, and for aviation purposes the figures were down around 1 kg per hp, while the fuel consumption was around ¼ kg per hp-hour for conventional engines and 0.16–0.20 kg per hp-hour for diesels. Combustion pressures had, by the 1950s, been raised to around 100 kg per cm$^2$ for diesels, and the stresses on connecting rods and bearings began to be high. During the 1980s, the figures have been further improved by increasing the combustion pressure, which has reached 200 kg per cm$^2$, i.e. 200 bar, but as a result connecting rods and bearings, piston bolts and crankshafts are approaching their maximum loadings, so that a change somewhere in the engine system is called for.

SUMMARY OF THE INVENTION

The combustion engine according to the invention constitutes a solution to these problems. In the Diesex 4 engine there will, quite contradictorily, be a combustion pressure approaching 300 bar, but this pressure is now equalized first and buffered down to a desired figure of 30–35 bar, which can in this context become both a maximum, average and minimum value (see the indicator diagram in FIG. 13). The combustion pressure is now extended and evenly distributed throughout the entire work stroke. As a consequence, a Diesex 4 engine for up to 200 hp need only weigh some 80 kg and has a fuel consumption as low as 0.125 grams per horsepower.

This has been achieved by designing a cam curve on the Diesex 4 engine such that the pistons during the work stroke only receive the very rapid acceleration required to unload, equalize and buffer the very high combustion pressure on the pistons during their start and the first part of the motion of each piston stroke. This motion is then braked to a stop before bottom dead center, whereupon the mass force from the retardation of the pistons supplements the gas pressure on the pistons, which is gradually falling towards the stop position, so that it is raised to the full $P_{mi}$-value (see the indicator diagram in FIG. 13) and that the acceleration and retardation of the pistons during the compression stroke are chosen so that a resulting line, known as the reference line (5-bar line) is produced (see indicator diagram in FIG. 13). This reference line, which is calculated to fall at around 5 bar, means that the pistons are held pressed against the cam curve under a pressure of 5 bar, i.e. 250 kg, during the entire compression strokes.

When the pistons change direction on transition to the expansion stroke, the 250 kg increases to the $P_{mi}$ pressure (i.e. about 35×the piston area=35×50=1750 kg), instead of the figures of 6,000 to 8,000 kg, i.e. 120 to 160 bar, that are current nowadays.

Because, in the Diesex 4 engine, the major part of each piston stroke take place in less than half the time for a motion period compared with current motors, and because this piston stroke happens when the engine is at its hottest, heat loss is also halved. Thus the thermodynamically efficient cylinder system of the Junkers engine has been made even more efficient by the Diesex 4 engine. In addition, the Diesex 4 engine has an entirely new exceptionally easily assembled roller bearing piston motion system. This increases the overall efficiency by a further five or so percentage points compared with conventional plain bearings.

Additionally, in the Diesex 4 engine, the piston driving system makes it possible to extend considerably the opening times for exhaust and scavenging, so that the time gain from the short, extra-fast expansion time of the piston can be overexploited. In this way the total time for exhaust and scavenging can be increased by up to a factor of 2 compared with the normal time, owing to the greatly increased time area. Despite this it is possible to lower the port heights in the engine by as much as 20% compared with the alarmingly high exhaust ports of current two-stroke engines, which in turn further increases the efficiency of scavenging. This gives several advantages. Very heavy pistons can be used in the engine, the mass forces of the pistons reduce the load on the combustion pressures the more effectively the heavier they are, and entirely without giving rise to the damaging vibrations that are unavoidable with current engines and heavy pistons. Calculations for the 1-liter Diesex 4 engine described here were based on pistons of 4 to 60 kg. The most suitable approach is therefore to use almost solid pistons of steel, well matched to the thermal expansion of the cylinders. Such pistons require minimum piston clearance, provide maximum gas-tightness, give the most efficient possible piston ring set, low oil consumption and silent engine running.

Even if the total weight of the pistons is perhaps 15 to 20 kg higher than a normal piston set, the resulting reduction in the total weight of the engine is many times this piston weight increase, owing to reduced total dimensions, the absence of connecting rods and the scope for weight reduction arising from the fact that the stress forces are far more than halved.

An indicator diagram for a fast running supercharged two-stroke diesel engine according to the invention has approximately the curve shown in FIG. 13, where the piston travel is the abscissa in millimeters and the pressure in bar is the ordinate. The curve is known as $P_g$ (the gas pressure curve). See FIG. 13.

The $P_{mi}$ line is shown at 35 bar. It is therefore desirable that the acceleration sequence for the piston relieves the partially very high combustion pressure, if possible right down to the constant $P_{mi}$ value (in this case 35 bar—compare FIG. 13) during the entire expansion phase (working phase) of the piston. It is a consequence of this that the acceleration curve should follow a pressure line that continuously has a value equal to the combustion pressure know as $P_g$ but after this has been reduced by $P_{mi}$ (i.e. in this case $P_{mi}=35$ bar) and we call the new curve $P_r$ ($=P_{resultant}$).

$P_r$ will be a curve that has a contour that is an exact likeness of the contour for $P_g$, but which is moved downward by 35 bar in the diagram relative to $P_g$.

If a piston weight M of 4 kp is chosen, speed N rev/-min, cam curve diameter D mm, piston stroke 50 mm, then the time that must elapse for the piston, during its motion from top dead centre to bottom dead centre, to reach the various fixed points, here 5, 10, 20, 35 etc. up to 45–50 mm of the piston travel, in precisely the times that correspond to the acceleration during the piston motion, the acceleration represented perhaps the travel points (v 5, v 10, v 20, - - - v 50) by the $P_r$ curve, i.e. the $P_r$ curve can be said to relieve the $P_g$ curve at all points down to the $P_{mi}$ value.

To ensure that the necessary pressure is always present in the cylinders immediately after starting of the engine, the pressure that ensures that the pistons are constantly held pressed against the cam curve, gas discharge from the engine should always go via a spring loaded valve providing a positive pressure of about 0.5 bar, in order to prevent piston slap.

Thermodynamic researchers maintain that increased combustion pressure through higher supercharging and higher compression ratio could give today's engines 20% and possibly 30% higher output, fuel economy and even more in terms of lower weight and reduced overall dimensions, but engine manufacturers also know from ruined engines, siezed bearings and bent connecting rods that, with current combustion pressures of 200 bar, they are already approaching what is at present considered to be a maximum upper load limit for an engine. However, the Diesex 4 engine is not subject to these limitations.

In the Diesex 4 engine it is its piston motion that solves these problems, and this in turn leads to great scope for additional improvement.

In today's combustion engines it is the connecting rod motion that entirely defines the stages of piston motion as a motion that, on closer inspection, only to a small extent satisfies the requirements that would best serve a combustion engine. The connecting rod motion moves the pistons from top to bottom dead center, but there is a great deal more that is asked of it.

Experience of valves and cam motions from racetrasks particularly highlights the importance of the combination of the weight, acceleration and retardation of fast moving parts in combustion engines.

The similarity between cam motion problems and piston motion problems is plain, and there is good reason to use the possibilities of cam motion to transfer piston motion to the rotating shaft of the engine.

Here, however, the new combination of rolling bearings in the Diesex 4 engine constitutes an extremely important solution of the bearing problem. It should be noted that rolling bearing systems hitherto used for engine shafts, while admittedly easy-running, are particularly difficult to assemble.

Here they have been replaced by the likewise easy-running but particularly easily assembled rolling bearing combination of the Diesex 4.

The motion transfer system according to the invention above all performs the same function as the connecting rod motion performs today, but they also give the pistons such a high mass weight M Kg that they can at any instant be given, and are given, such a speed h and an acceleration a that the combustion pressure $P_g$ (stated in bar) minus the acceleration force at every instant $P_r$ becomes equal to $P_{mi}$, thus $P_g-P_r=P_{mi}$.

The present invention is also a development of the Junkers two-stroke engine with double opposed pistons in each cylinder. As long ago as the Second World War, the Junkers engine achieved record figures. In terms of fuel economy it has hardly been surpassed since. However, because of the perhaps unduly complicated design with double crankshafts connected by means of a costly system of gears, it was not wholly successful.

By combining the Diesex 4 engine according to the present invention with the Junkers combustion system and its perfect balance, a major step forward in engine development is achieved. The Diesex 4 engine's highly efficient system for the transfer of motion between piston and driveshaft not only greatly simplifies the Junkers system but also gives an extremely effective reduction down as far as one-tenth of the stress figures in currently used combustion systems before the stresses have reached the parts of the engine that are most sensitive to over-stressing. Instead of a devastating explosive blast of about 10 tonnes for a fraction of 0.001 seconds, it is reduced in the present invention down to a force of 2 tonnes, acting instead at practically constant force during the entire compression stroke. In terms of work output, this extended force of hardly 2 tonnes far exceeds the 10-tonne explosion of the combustion processes in use today, and is, in figurative terms, delivered wrapped in cotton wool.

It being well known that, the higher the combustion pressure worked with, the better the output and fuel economy obtained, but is also being known that this results in a prematurely destroyed engine, the present invention makes it possible to greatly increase the output and economy of an engine without shortening its life. By virtue of the equalized, smooth working pressure obtained according to the invention, the maximum pressure can be kept as low as around 40 bar. This is instead of the devastating forces of 150–200 bar that arise nowadays during the maximum working strokes of engines, and of which only 20–30 bar of useful working pressure can be exploited. This greatly reduced stress pressure makes possible extra light constructions and smaller overall dimensions. A 150–200 hp engine according to the invention, with a rotation speed of 4,000 to 4,2000 r/min, is calculated to weigh less than 80 kg, to be 540 mm long, 300 mm high and 400 mm wide, in a diesel version.

The combustion engine according to the invention has at least one cylinder with a pair of opposed pistons. Where there are several cylinders, these are placed in a circular arrangement around and parallel to a common drive shaft.

THE DRAWINGS

An embodiment of the engine according to the invention is shown in the accompanying drawings, where FIG. 1 shows the engine schematically, viewed from above, FIG. 2 shows the engine in FIG. 1 seen from one end, FIG. 3 shows the engine in FIG. 1, partly in cross-section, FIG. 4 shows the transfer of motion between a piston and the cam curve, partly in cross-section, FIG. 5 shows the piston and a groove in the cam curve and a cam roller in the cam curve in FIG. 4, viewed from above, partly in cross-section, FIG. 6 shows the piston and cam curve in FIG. 4, viewed from the side, partly in cross-section, FIG. 7 shows the piston and cam curve in FIG. 6, viewed from above, FIG. 8 shows a cam roller for a piston, FIG. 9 shows the interaction of a cam roller with a cam curve, FIG. 10 shows a scavenging half of a cylinder, FIG. 11 shows the interaction between cylinders and cam curves in a four-cylinder version with double pistons in each cylinder, FIG. 12 shows indicator curves for gas pressure in a conventional engine of the same size and general type as the engine according to the invention, with crankshaft angle $\phi$ as the X-axis, FIG. 13 shows an indicator diagram for the engine according to the invention, i.e. a Diesex 4 engine.

DETAILED DESCRIPTION OF PREFERRED EMBODIMENTS OF THE INVENTION

Figure 1:
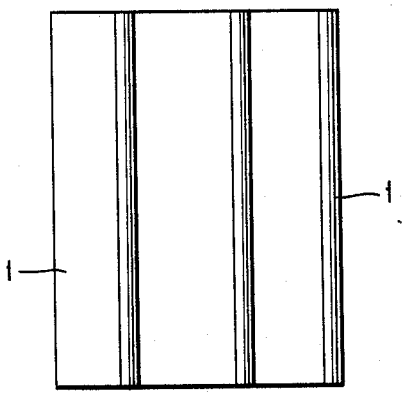
Figure 2:
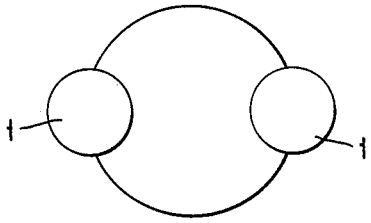

The engine according to the invention shown on the drawings works according to the "opposed piston system principle". In each cylinder 1, two pistons 2 move towards and away from each other in the known manner. The pistons have a common combustion chamber 3 between them.

The motion of the pistons is parallel to the direction of the driveshaft 4 of the engine and is transferred to three cams 5 that are evenly distributed each on its own end face of two washers 6 facing each other. The washers 6 are fixed on driveshaft 4. As the drawings show, the cams 5 also produce, with the aid of cam rollers 7 carried on rolling bearings on pistons 2, lifting motions in a direction parallel to driveshaft 4, which force the piston 2 to lift a predetermined distance, i.e. its stroke, up to its top position. The corresponding cam 5 of the opposite washer 6 simultaneously works in a similar manner on the other piston 2 of the common cylinder 1 so that this other piston 2 reaches its top position simultaneously or possibly with a certain insignificant displacement. The high compression pressure in the common combustion chamber 3 in each cylinder 1 of the engine then presses the pistons 2 back to their bottom position. As this happens, each piston follows its cam 5, which has been calculated with regard to the acceleration of piston 2 that is matched to the mass force, so that at every instant $P_g - Pr = P_{mi}$ (see the indicator diagram in FIG. 13). The cam curve includes circumferentially spaced peaks 5A and valleys 5B interconnected by concave interconnecting surfaces 5C, the steepness of which progressively decreases from adjacent the peak to adjacent the valley.

In an example of a motor, the piston motion of a two-cylinder motor with 1,000 cc swept volume is determined by the following parts: A driveshaft 4 with length L=540 mm and with a diameter D=100 mm. The driveshaft 4 may be in the form of a centreless-ground steel tube with 5 mm material thickness. This is connected to each washer 6 with a 100 $cm^2$ bonded and pinned joint that withstands a torque of 1 tonne-meter, corresponding to a safety factor of 20. The entire bearing arrangement of driveshaft 4 in the ends 8 of cam housing 9 consists of two thrust bearings 10 of 230 mm outside diameter with a load capacity of about 20 tonnes.

Thanks to the design of the Diesex 4 engine, these need not have a higher speed than 1,400 n/min (but can withstand about 2,200 n/min).

The carbide-reinforced cam rollers 7 are subjected to max a maximum 1,800 kg loading and a rolling speed of 17.5 m/s but are considered capable of withstanding twice the number of kg and a rolling speed of 16,000 bar/min, but they work at only 9,500 r/min.

In order to match the speed of thrust bearing 10 and the rolling speed against the form of cam curves 11 of the cam rollers 7 to suitable values, each cam curve 11 has been provided with three cams 5 on each washer 6.

With this design, the number of cams 5 times the speed of washers 6 will determine the number of strokes per cylinder and minute of the engine, a figure that should be compared with the revolutions per minute of engines in use today. In accordance with this, the present engine according to the invention has a stroke n=4,000–4,200 per min and washer pair. The speed will then be 4,000/3 to 4,200/3=1,333 to 1,400 per min or 22.22–23.33 per second, corresponding to 9,100 to 9,500 revolutions per minute for the bearings 14 of cam roller 7 as against the permitted figure of 15,000 revolutions per minute.

The number of cams 5 on washers 6 therefore determines the reduction ratio of driveshaft 4. For four cams, the reduction on the number of strokes will be 1:4. For a helicopter engine, for example, a sevenfold gear-free reduction can very easily be obtained simply by fitting cam curves 11 with seven cams 5 and making the engine according to the invention with, for example, up to 10 cylinders (the number of cylinders should not be divisible by the number of cams in order that more than one cylinder does not fire simultaneously) or up to 20 cylinders in a cylinder ring with a diameter of only about 1 m and a length of 60 cm in a power class of about 1,000 and 2,000 hp respectively. The washer diameter then increases in proportion to the number of cams in order that the steepness and the radii of curvature of the cam tops of cam curves 11 can be kept within the desired limits.

The cam rollers 7 transfer the lifting motion from the cams 5 on cam curve 11 on washers 6 to the piston. Each cam roller 7 may appropriately be a roller of carbide, press-fitted to a journal 12 that is carried on rolling bearings in piston 2 by means of the two rolling bearings 14.

Figure 12:
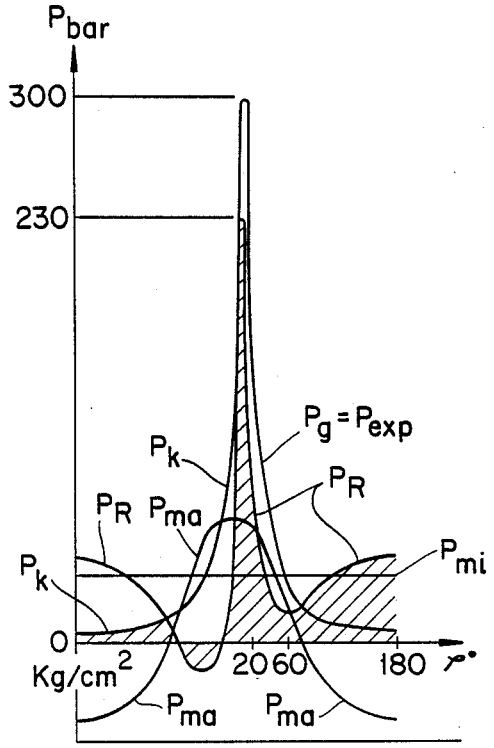
Figure 13:
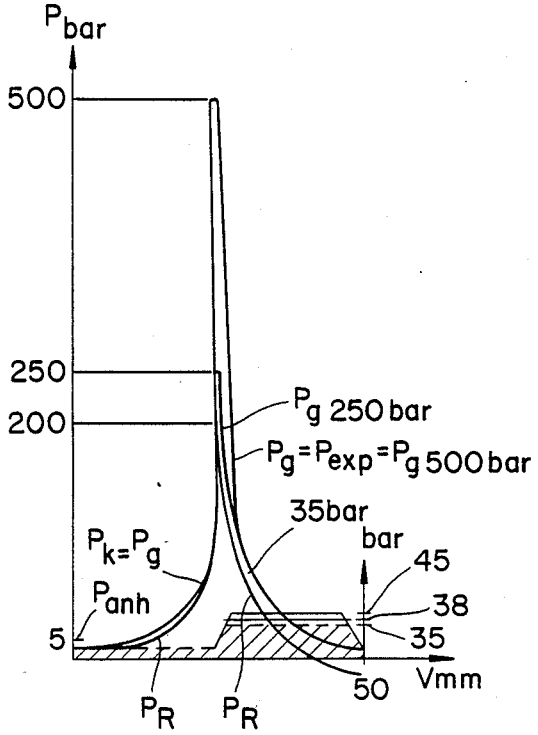

The lifting motion is transferred from a cam 5 on cam curve 11 to the piston 2 with the washer 6 on drive shaft 4, so that the piston 2 precisely follows its $P_r$ curve in the diagram in FIG. 13, the calculated motion $P_g$, as a consequence of which $P_g - P_r$ with the mass of piston 2 must give at each instant the value $P_{mi}$ throughout the entire expansion stroke. The diagrams in FIG. 12 and 13 show curves for:

$P_k$=compression pressure $P_g$=gas pressure (=combustion pressure $P_{exp}$ for current engines)

$P_R$=resulting pressure $P_{ma}$=mass force pressure $P_{me}$=effective mean pressure $P_{mi}$=indicated combustion pressure $P_{anh}$=reference pressure=a On the other hand, during the entire compression stroke $P_k$-$P_R$ must be equal to one contact force a for a cam roller 7 (here the chosen value of a is 5 bar). In order that cam roller 7 makes accurate contact with the curve surface of cam curve 11 along its entire contact surface with cam curve 11, the journal 12 is positined in a bore13 passing right through piston 2. In this bore 13 can roller 7 is centrally carried and pressed onto journal 12, which in turn is carried between a roller bearing 14 at each end of the journal. So that cam roller 7 sets itself automatically in accordance with the profile of cam curve 11, the profile of cam roller 7 rolling against cam cuve 11 is shaped as the middle sector of a sphere (for example with 35 mm diameter). The cam curve 11 must therefore have a groove 15 with a cross-section profile that exactly fits the spherical rolling surface of cam roller 7. The bearing arrangement of cam roller 7 permits an even distribution of the load on its two roller bearins 14, so that the sum of the load capacity of the two rolling bearings 14 is exploited. An example of a suitable diameter for cam roller 7 is 35 mm and, for the radius of curvature of the top rounding of a cam 5, 15 mm.

Several advantages are gained with the present invention. With the engine according to the invention it is possible to obtain a load reduction and equalization of the combustion pressure down to a constant value of $P_{mi}$ (calculated here to 35 bar) throughout the entire work stroke as shown in the diagram in FIG. 13.

This diagram also shows how a reduction of the pressure $P_k$ during the compression strokes can be achieved down to a suitable constant value (calculated here to 5–10 bar) by which the piston 2 should be held in contact with cam curve 11 throughout the entire compression stroke, in order never to lose contact with it. This guarantees that the motion for which is it calculated is followed. The calculations are illustrated by the curves in the indicator diagram in FIG. 13, with the following values of max pressure $P_{max}$ and the corresponding $P_{mi}$ at the piston travel V in mm.

| For $P_{max}$ corresponding to $P_{mi}$ |
|---|
| 500 bar corresponding to 45 bar |
| 250 bar corresponding to 38 bar |
| 200 bar corresponding to 35 bar |

With the motor acording to the invention, a power gain is also achieved by the greatly shortened heat loss time during the hottest part of the work period.

Such an engine is also advantageous owing to the greatly extended time that is available, owing to the shortened expansion time, for exhausting and scavenging, both in accordance with the previous paragraph and as a result of the shape of the piston motion curve.

Figure 3:
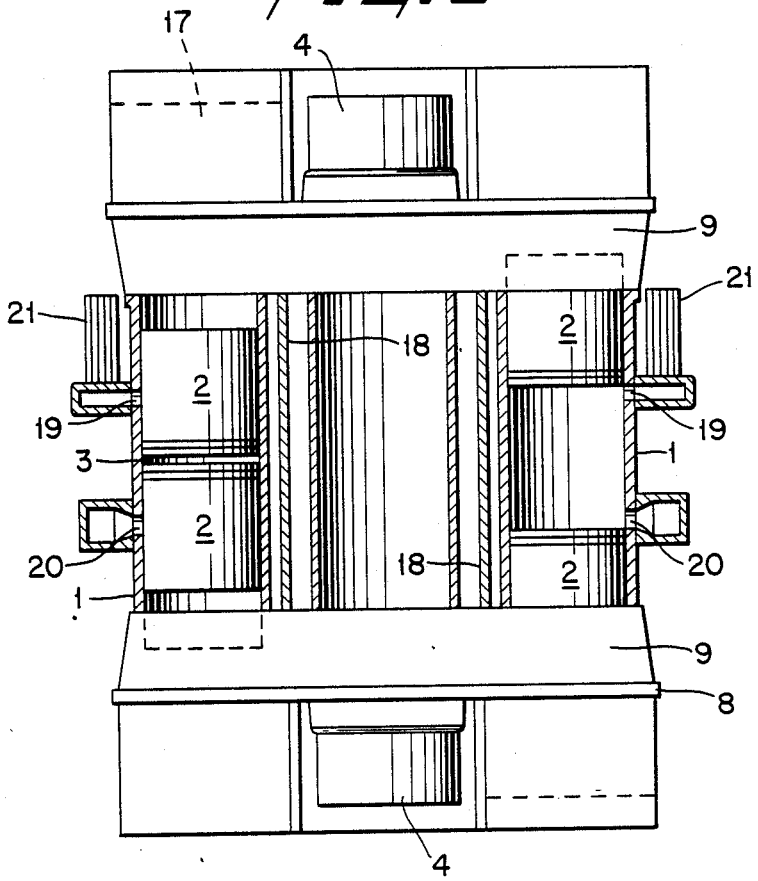
Figure 9:
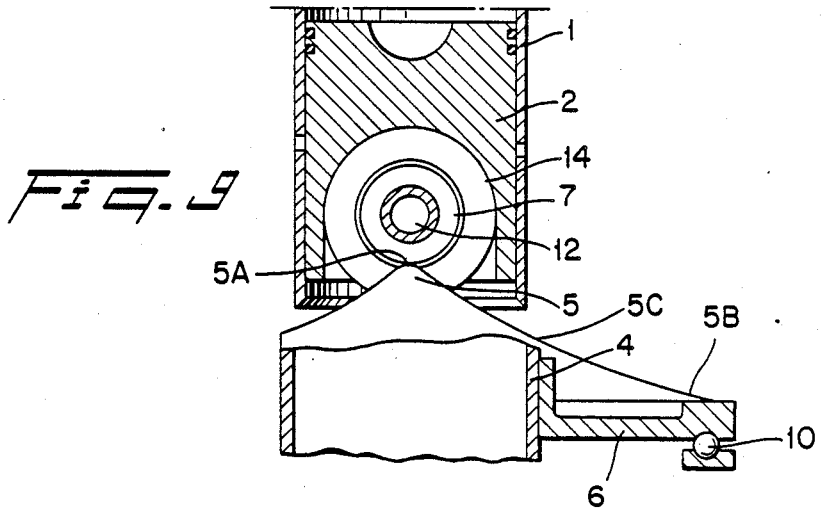
Figure 10:
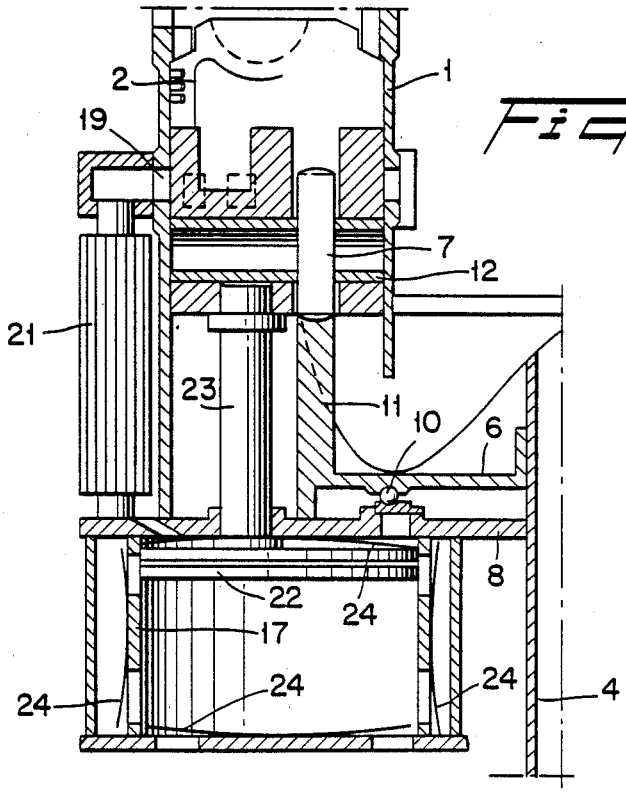
Figure 11:
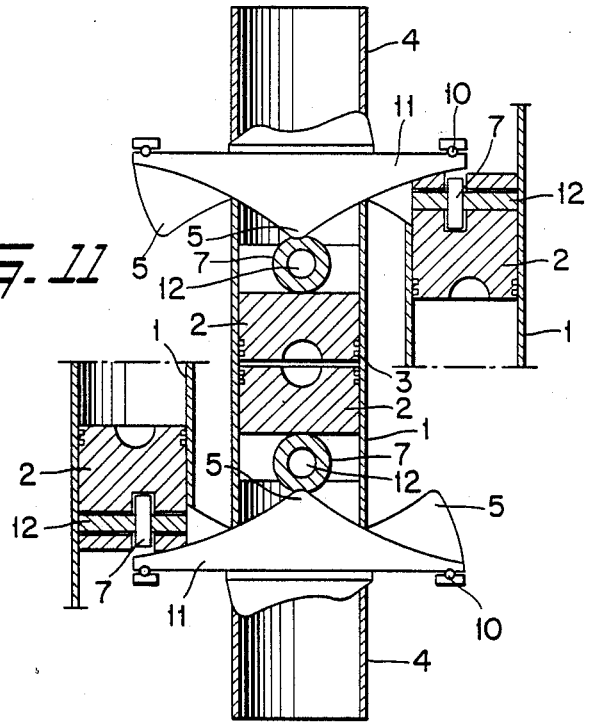

FIG.10 shows the scavenging half of a cylinder 1. Its piston 2 transfers its motion by means of a plunger 23 to a compressor piston 22 in a compressor cylinder 17 to scavenge cylinder 1 of the motor via a scavenge cooling battery 21 and a scavenge duct 19. The induction and exhaust openings of compressor cylinder 17 are fitted with leaft springs 24. The cylinder also has an exhaust duct 20 (see FIG. 3).

Compared with engines of the type with "opposed piston two-cycle engine" (or the Jumos system) the engine according to the invention has additionally improved balancing efficiency determined by the cam curves.

The motor is also advantageous through the absence of gears for reduction. The cam curve 11 is its reduction system.

Allowing the gas pressure to ensure the return motion of the pistons in the engine according to the invention is not more dangerus than allowing the return motion of valves to be ensured by springs in a four-stroke engine.

To guarantee that the fuel is supplied to the cylinders with maximum reliability, the engine should be provided with two independent entirely separate and complete fuel supply systems.

A condition for reliable operation of the Diesex 4 engine is that the scavenge air system in the engine is guaranteed to provide 0.5 to 1 bar positive pressure at the instant of starting, and that a corresponding counterpressure exists in the exhaust system at the same time.

This is made possible by giving the cam curves such a shape that the dynamic mass forces, the acceleration and the retardation of the piston are balanced against the pressure, ignition pressure and combustion pressure of the indicator diagram.

It should also be noted that the Diesex 4 engine probably has or will have its most important fields of application in combination with turbo compressor equipment, in other words in the super-high-pressure engine field, precisely where the stress-relieving characteristics of the Diesex 4 will be of extra value and where new areas of power and economy open up which have not been possible for today's engine types owing to problems with material overloading.

Although the diesel Diesex 4 engine is suitable for vehicle engines, the engine is even more suitable for most other types, from the smallest at 50 hp and a weight of 10 kg for aircraft and helicopters (single-seater) to the largest, up to more than 100,000 hp with weights of 2 kg per hp and possibly fueled with a mixture of water and powdered coal or peat, the latter with turbo-compressor of course. This opens up considerable additional possibilities for increased output and economy.

All dimension data relate to an engine size in which the swept volume of the cylinder 1 is 500 $cm^3$, the piston diameter is 80 mm, the stroke is 50 mm, the number of cylinder strokes per minute is 3,600–4,200, $P_{me}$ is 22.4 bar, the output is 200 hp, the weight is less than 80 kg and the front area of the engine is of the order of 12 $dm^2$.

The Diesex 4 engine is even more attractive if it is provided with internal water spray cooling with a simple bump mechanism. The cooling water can be recovered from the exhaust gases. In this way 30% extra heat becomes available as fuel.

Already within one start revolution the Diesex 4 engine delivers the necessary positive pressure for starting.

What is claimed is:

1. A combustion engine comprising:

a plurality of cylinders each containing a pair of aligned pistons displaceable toward and away from one another, said cylinders including inlet and outlet ports for admitting fuel and discharging exhaust gas, each piston carrying a cam roller;

a drive shaft; and rotary cam disc means connected to said drive shaft and arranged to be contacted by said cam rollers of said pistons for transferring motion between said rotary cam disc means and said pistons, said rotary cam disc means including cam curves arranged to be engaged by cam rollers of respective pistons of each said pair of pistons, each cam curve having circumferentially spaced peaks and valleys whereby a cam roller travels from a peak to a valley during a power stroke of said piston, each peak being connected with a successive valley by an interconnecting surface of said cam curve along which a respective cam roller travels during a power stroke, said interconnecting surface presenting a slope which progressively decreases from adjacent said peak to adjacent said valley.

2. A combustion engine according to claim 1, wherein said interconnecting surfaces are of concave configuration.

3. A combustion engine according to claim 1 including roller bearings rotatably mounting said cam rollers on said pistons.

4. A combustion engine according to claim 1, wherein the number of cam peaks is different from the number of cylinders.

5. A combustion engine according to claim 1 including a compressor cylinder for scavenging said first-named cylinders, said compressor cylinder including a compressor piston arranged to be driven in response to actuation of said first-named pistons.

6. A combustion engine according to claim 5 including means for cooling the scavenged gas.

7. A combustion engine according to claim 1, wherein said exhaust ports are closed by spring-biased valves.

8. A combustion engine according to claim 1, wherein said interconnecting surface interconnects each peak with a preceding valley.

* * * * *